US007059842B2

(12) United States Patent
Lee et al.

(10) Patent No.: US 7,059,842 B2
(45) Date of Patent: Jun. 13, 2006

(54) VARIABLE CAPACITY ROTARY COMPRESSOR

(75) Inventors: Moon Joo Lee, Suwon (KR); Seung Kap Lee, Suwon (KR); Chun Mo Sung, Hwasung (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 240 days.

(21) Appl. No.: 10/839,357

(22) Filed: May 6, 2004

(65) Prior Publication Data

US 2005/0069422 A1 Mar. 31, 2005

(30) Foreign Application Priority Data

Sep. 30, 2003 (KR) ..... 10-2003-0068056

(51) Int. Cl.
*F03C 2/00* (2006.01)
*F04C 23/00* (2006.01)

(52) U.S. Cl. ..... 418/60; 418/159; 418/270; 418/29; 417/218; 417/221; 417/223; 417/410.3

(58) Field of Classification Search ..... 418/23, 418/29, 60, 63, 270, 159; 417/218, 221, 417/410.3, 223
See application file for complete search history.

(56) References Cited

U.S. PATENT DOCUMENTS 4,780,067 A * 10/1988 Suzuki et al. ..... 417/295
6,796,773 B1 * 9/2004 Choi et al. ..... 418/60
6,935,853 B1 * 8/2005 Lee et al. ..... 418/60

FOREIGN PATENT DOCUMENTS

JP 59147895 A * 8/1984 ..... 418/60
JP 61272492 A * 12/1986 ..... 418/60
JP 62070686 A * 4/1987 ..... 418/60
JP 63057889 A * 3/1988 ..... 418/60
JP 04187892 A * 7/1992

OTHER PUBLICATIONS

Patent Abstracts of Japan, Publication No. 61-129495, Jun. 17, 1986.

* cited by examiner

*Primary Examiner*—Theresa Trieu
(74) *Attorney, Agent, or Firm*—Staas & Halsey LLP

(57) ABSTRACT

A variable capacity rotary compressor including a hermetic casing, and a housing installed in the hermetic casing to define therein first and second compression chambers having different capacities. A compressor is placed in the first and second compression chambers and operated to execute a compression operation in either the first or second compression chamber according to a rotating direction of a rotating shaft which drives the compressing unit. A pressure controller applies the outlet pressure of the compressor to the first or second compression chamber where an idle operation is executed, and has a path control chamber provided at a portion of the housing outside the first and second compression chambers. First and second inlet channels connect both ends of the path control chamber to inlet ports of the first and second compression chambers, respectively. A communicating channel connects an outlet side of the compressor to the path control chamber. A valve unit, in the path control chamber, controls an internal path of the path control chamber.

16 Claims, 9 Drawing Sheets

VARIABLE CAPACITY ROTARY COMPRESSOR

CROSS-REFERENCE TO RELATED APPLICATIONS

This application claims the benefit of Korean Patent Application No. 2003-68056 filed Sep. 30, 2003 in the Korean Intellectual Property Office, the disclosure of which is incorporated herein by reference.

BACKGROUND OF THE INVENTION

1. Field of the Invention

The present invention relates, in general, to variable capacity rotary compressors and, more particularly, to a variable capacity rotary compressor which has a pressure controller to allow an internal pressure of a compression chamber where an idle operation is executed, to be equal to an internal pressure of a hermetic casing.

2. Description of the Related Art

Recently, a variable capacity compressor has been increasingly used in a variety of refrigeration systems, such as air conditioners or refrigerators, so as to vary a cooling capacity as desired, thus accomplishing an optimum cooling operation and a saving of energy.

An earlier patent disclosure dealing with a variable capacity compressor is found in U.S. Pat. No. 4,397,618. According to the patent, a rotary compressor is designed to vary a compression capacity thereof by holding or releasing a vane. The rotary compressor includes a casing in which a cylindrical compression chamber is provided. A rolling piston is installed in the compression chamber of the casing to be eccentrically rotated. Further, a vane, designated as a "slide" in U.S. Pat. No. 4,397,618, is installed in the casing, and reciprocates in a radial direction while being in contact with an outer surface of the rolling piston. A vane holding unit, which includes a ratchet bolt, an armature, and a solenoid, is provided at a side of the vane to hold or release the vane, thus varying the compression capacity of the rotary compressor. That is, the vane is held or released in response to a reciprocating movement of the ratchet bolt controlled by the solenoid, thus varying the compression capacity of the rotary compressor.

However, the conventional variable capacity rotary compressor has a problem in that it is designed such that the compression operation thereof is controlled by holding or releasing the vane for a predetermined period of time, so it is difficult to precisely vary the compression capacity to obtain a desired exhaust pressure.

Further, the conventional variable capacity rotary compressor has another problem in that the ratchet bolt holding the vane is designed to enter a side of the vane and be locked to a locking hole formed at the vane, so it is not easy to hold the vane which reciprocates at a high speed when the compressor is operated, thus having poor reliability.

SUMMARY OF THE INVENTION

Accordingly, it is an aspect of the present invention to provide a variable capacity rotary compressor, which is designed to precisely vary a compression capacity to obtain a desired exhaust pressure, and to easily control an operation of varying the compression capacity.

It is another aspect of the present invention to provide a variable capacity rotary compressor which has a pressure controller to allow an internal pressure of a compression chamber where an idle operation is executed, to be equal to an internal pressure of a hermetic casing, which is a pressure of an outlet side of the compressor, to prevent a vane from pressing an outer surface of a roller and preventing oil from flowing into the compression chamber, therefore minimizing a rotating resistance.

Additional aspects and/or advantages of the invention will be set forth in part in the description which follows and, in part, will be obvious from the description, or may be learned by practice of the invention.

The variable capacity rotary compressor includes a hermetic casing, a housing, a compressing unit, and a pressure controller. The housing is installed in the hermetic casing to define therein first and second compression chambers having different capacities. The compressing unit is placed in the first and second compression chambers, and is operated to execute a compression operation in either the first or second compression chamber according to a rotating direction of a rotating shaft which drives the compressing unit. The pressure controller is operated to apply a pressure of an outlet side of the compressor to either the first or second compression chamber where an idle operation is executed, and includes a path control chamber, first and second inlet channels, a communicating channel, and a valve unit. The path control chamber is provided at a predetermined portion of the housing outside the first and second compression chambers. The first and second inlet channels connect both ends of the path control chamber to inlet ports of the first and second compression chambers, respectively. The communicating channel connects the outlet side of the compressor to the path control chamber. The valve unit is provided in the path control chamber to control an internal path of the path control chamber so that the communicating channel communicates with either the first or second inlet channel.

The valve unit may include a valve member which reciprocates in the path control chamber. The valve unit may further include first and second valve seats which are provided on the ends of the path control chamber, respectively. Each of the first and second valve seats may have a hole at a center thereof.

The valve unit may further include first and second valve seats which are provided on the ends of the path control chamber, respectively. Each of the first and second valve seats may have a hole at a center thereof.

The housing may include a first housing which defines the first compression chamber therein, a second housing which defines the second compression chamber therein, and a partition which is interposed between the first and second housings parts so that the first and second compression chambers are partitioned from each other.

The first compression chamber may have a higher capacity than the second compression chamber. The path control chamber may be provided at a predetermined portion of the first housing. The second inlet channel may be provided at a predetermined portion of the partition to allow the path control chamber to communicate with the inlet port of the second compression chamber.

The communicating channel may be provided at a predetermined portion of the first housing, with an inlet of the communicating channel being open to communicate with an interior of the hermetic casing.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
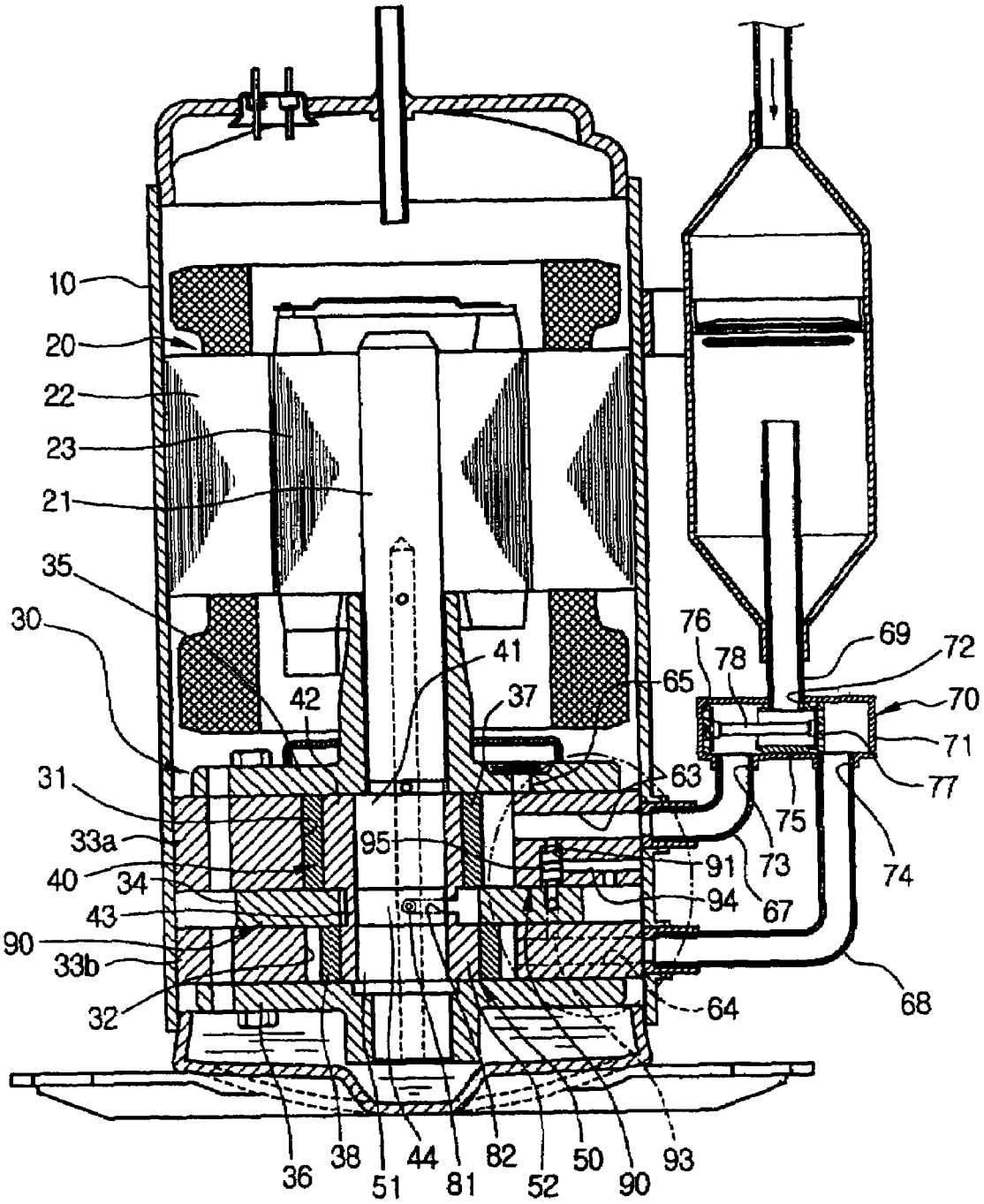
FIG. 1 is a sectional view of a variable capacity rotary compressor, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

As shown in FIG. 1, a variable capacity rotary compressor according to the present invention includes a hermetic casing 10, with a driver 20 and a compressing unit 30 being installed in the hermetic casing 10. The driver 20 is installed on an upper portion of the hermetic casing 10 to generate a rotating force. The compressing unit 30 is installed on a lower portion of the hermetic casing 10 to be connected to the driver 20 through a rotating shaft 21. The driver 20 includes a cylindrical stator 22 and a rotor 23. The stator 22 is mounted to an inner surface of the casing 10. The rotor 23 is rotatably and concentrically set in the stator 22, and is mounted to the rotating shaft 21. The driver 20 rotates the rotating shaft 21 in opposite directions.

The compressing unit 30 includes a housing. Cylindrical first and second compression chambers 31 and 32, having different capacities, are provided on upper and lower portions of the housing, respectively. The housing has, at an upper portion thereof, a first housing 33*a* to define the first compression chamber 31 therein. Further, the housing has at a lower portion thereof a second housing 33*b* to define therein the second compression chamber 32 which has a smaller capacity than the first compression chamber 31. The housing also has upper and lower flanges 35 and 36 to rotatably support the rotating shaft 21. The upper flange 35 is mounted to an upper surface of the first housing 33*a* to close an upper portion of the first compression chamber 31, and the lower flange 36 is mounted to a lower surface of the second housing 33*b* to close a lower portion of the second compression chamber 32. A partition 34 is interposed between the first and second housings 33*a* and 33*b* so that the first and second compression chambers 31 and 32 are partitioned from each other.

As shown in FIGS. 1 to 4, the rotating shaft 21, installed in the first and second compression chambers 31 and 32, is provided with first and second eccentric units 40 and 50, which are arranged on upper and lower portions of the rotating shaft 21, respectively. First and second rollers 37 and 38 are rotatably fitted over the first and second eccentric units 40 and 50, respectively. A first inlet 63 and a first outlet 65 are formed at predetermined positions of the first compression chamber 31, and a second inlet 64 and a second outlet 66 are formed at predetermined positions of the second compression chamber 32. A first vane 61 is installed between the first inlet 63 and the first outlet port 65 of the first compression chamber 31, and reciprocates in a radial direction while being in contact with an outer surface of the first roller 37, thus executing a compression operation. Further, a second vane 62 is installed between the second inlet 64 and the second outlet port 66 of the second compression chamber 32, and reciprocates in the radial direction while being in contact with an outer surface of the second roller 38, thus executing the compression operation. The first and second vanes 61 and 62 are biased by first and second vane springs 61*a* and 62*a*, respectively. Further, the first inlet 63 and the first outlet 65 of the first compression chamber 31 are arranged on opposite sides of the first vane 61. Similarly, the second inlet 64 and the second outlet 66 of the second compression chamber 32 are arranged on opposite sides of the second vane 62. Although not shown in the drawings in detail, the outlets 65 and 66 communicate with an interior of the hermetic casing 10 via a path defined in the housing.

Figure 2:
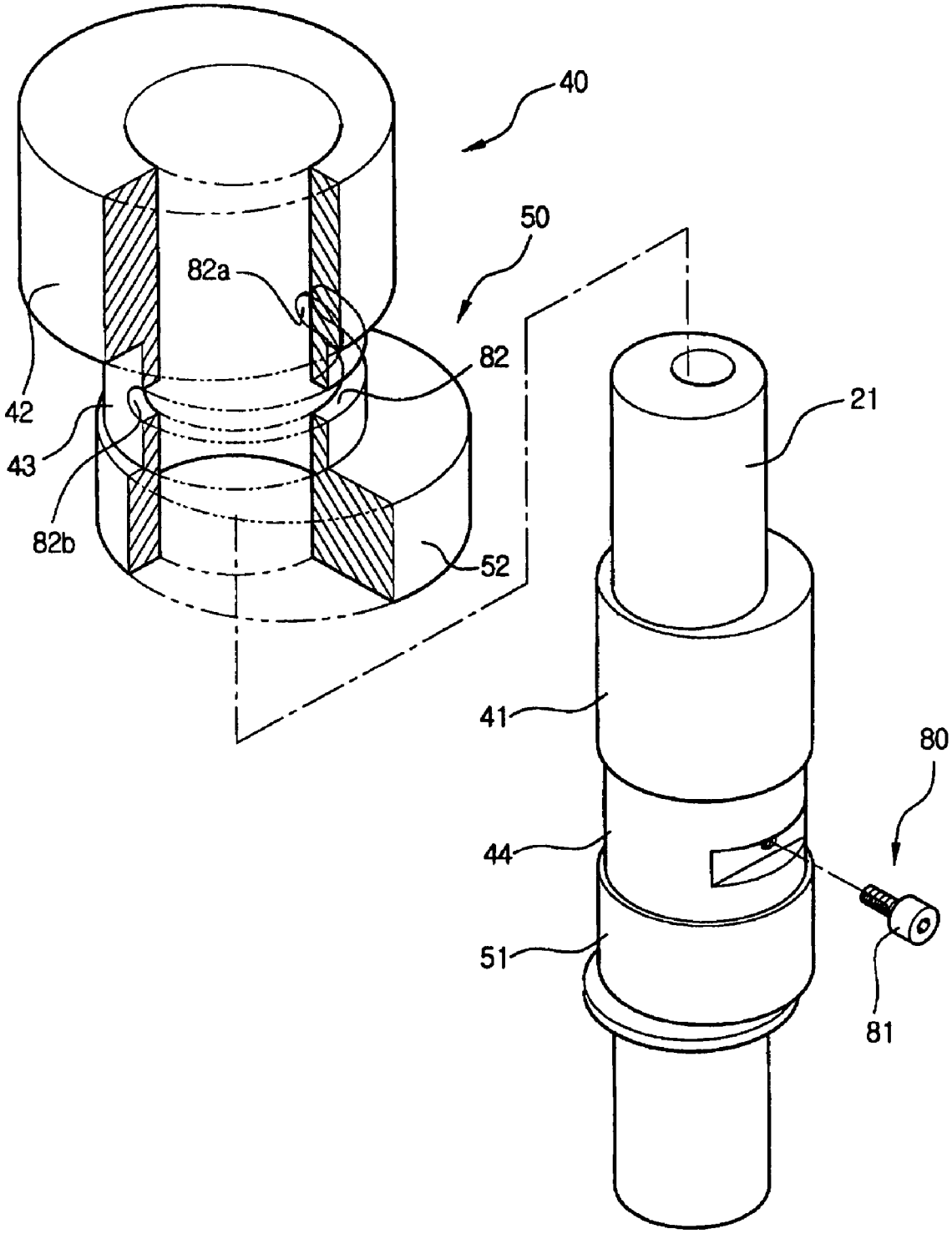
FIG. 2 is a perspective view of eccentric units included in the variable capacity rotary compressor of FIG. 1.

The first and second eccentric units 40 and 50 include first and second eccentric cams 41 and 51, respectively. The first and second eccentric cams 41 and 51 are provided on an outer surface of the rotating shaft 21 to be placed in the first and second compression chambers 31 and 32, respectively, while being eccentric from the rotating shaft 21 in a same direction. First and second eccentric bushes 42 and 52 are rotatably fitted over the first and second eccentric cams 41 and 51, respectively. As shown in FIG. 2, the first and second eccentric bushes 42 and 52 are integrally connected to each other by a cylindrical connector 43, and are eccentric from the rotating shaft 21 in opposite directions. Further, the first and second rollers 37 and 38 are rotatably fitted over the first and second eccentric bushes 42 and 52, respectively.

Figure 3:
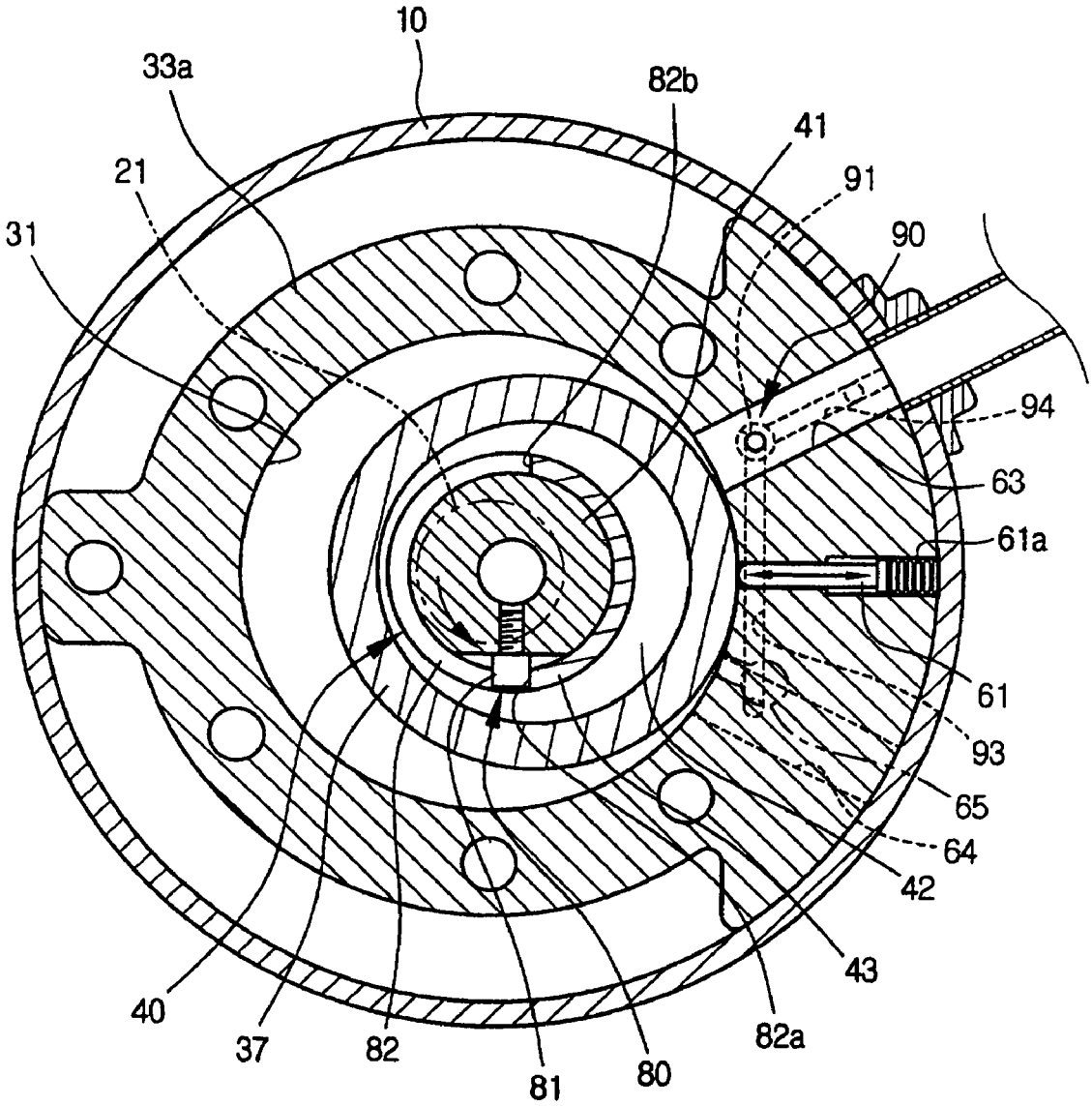
FIG. 3 is a sectional view to illustrate a compression operation of a first compression chamber, when a rotating shaft of the variable capacity rotary compressor of FIG. 1 is rotated in a first direction.

As shown in FIGS. 2 and 3, an eccentric part 44 is provided on the outer surface of the rotating shaft 21 between the first and second eccentric cams 41 and 51 to be eccentric from the rotating shaft 21 in the same direction as the first and second eccentric cams 41 and 51. A lock 80 is mounted to the eccentric part 44. In this case, the lock 80 functions to make one of the first and second eccentric bushes 42 and 52 be eccentric from the rotating shaft 21 while releasing a remaining one of the first and second eccentric bushes 42 and 52 from eccentricity from the rotating shaft 21, according to a rotating direction of the rotating shaft 21. The lock 80 includes a locking pin 81 and a locking slot 82. The locking pin 81 is mounted to a surface of the eccentric part 44 in a screw-type fastening method to be projected from the surface of the eccentric part 44. The locking slot 82 is formed around a part of the connector 43, which connects the first and second eccentric bushes 42 and 52 to each other. The locking pin 81 engages with the locking slot 82 to make one of the first and second eccentric bushes 42 and 52 be eccentric from the rotating shaft 21 while a remaining one of the first and second eccentric bushes 42 and 52 is released from the eccentricity from the rotating shaft 21, according to the rotating direction of the rotating shaft 21.

When the rotating shaft 21 is rotated while the locking pin 81 which is mounted to the eccentric part 44 of the rotating shaft 21 engaging with the locking slot 82 of the connector 43, the locking pin 81 is rotated within the locking slot 82 to be locked by either of first and second locking parts 82*a* and 82*b* which are formed at opposite ends of the locking slot 82, thus making the first and second eccentric bushes 42 and 52 be rotated along with the rotating shaft 21. Further, when the locking pin 81 is locked by either of the first and second locking parts 82*a* and 82*b* of the locking slot 82, one of the first and second eccentric bushes 42 and 52 is eccentric from the rotating shaft 21 and a remaining one of the first and second eccentric bushes 42 and 52 is released from the eccentricity from the rotating shaft 21, thus executing the compression operation in one of the first and second compression chambers 31 and 32 and executing an idle operation in a remaining one of the first and second eccentric compression chambers 31 and 32. On the other hand, when the rotating direction of the rotating shaft 21 is changed, the first and second eccentric bushes 42 and 52 are arranged oppositely to the above-mentioned state.

As shown in FIG. 1, the variable capacity rotary compressor according to the present invention also includes a path controller 70. The path controller 70 controls a refrigerant suction path so that a refrigerant fed from a refrigerant inlet pipe 69 is delivered into either the first inlet 63 of the first compression chamber 31 or the second inlet 64 of the second compression chamber 32. Therefore, the refrigerant is delivered into the first or second inlet depending on the compression chamber in which the compression operation is executed.

The path controller 70 includes a cylindrical body 71, and a valve unit, which is installed in the body 71. An inlet 72 is formed at a central portion of the body 71 to be connected to a refrigerant inlet pipe 69. First and second outlets 73 and 74 are formed on the body 71 at opposite sides of the inlet 72 to be connected to first and second pipes 67 and 68. The first and second pipes 67 and 68 are connected to the first inlet 63 of the first compression chamber 31 and the second inlet 64 of the second compression chamber 32, respectively. The valve unit which is set in the body 71, includes a cylindrical valve seat 75. The valve seat 75 is installed at a center of the body 71. First and second valve members 76 and 77 are installed at both sides of the body 71, and axially reciprocate in the body 71 to open either end of the valve seat 75. A connector 78, connects the first and second valve members to each other, so as to cause the first and second valve members to move together. The path controller 70 constructed as described above is operated as follows. When the compression operation is executed in either the first or second compression chamber 31 or 32, the first and second valve members 76 and 77 are moved toward either the first or second outlet 73 or 74, whichever has a lower pressure, due to a pressure difference between the first and second outlets 73 and 74, thus automatically changing a refrigerant suction path. In other words, the path controller 70 controls the refrigerant suction path so that a refrigerant is fed into the compression chamber 31 or 32 where the compression operation is executed.

As shown in FIG. 1, the variable capacity rotary compressor according to the present invention includes a pressure controller 90. The pressure controller 90 makes an outlet pressure of the compressor be applied to the compression chamber 31, 32 where the idle operation is executed, to allow the internal pressure of the compression chamber where the idle operation is executed, to be equal to the internal pressure of the hermetic casing 10.

Figure 7:
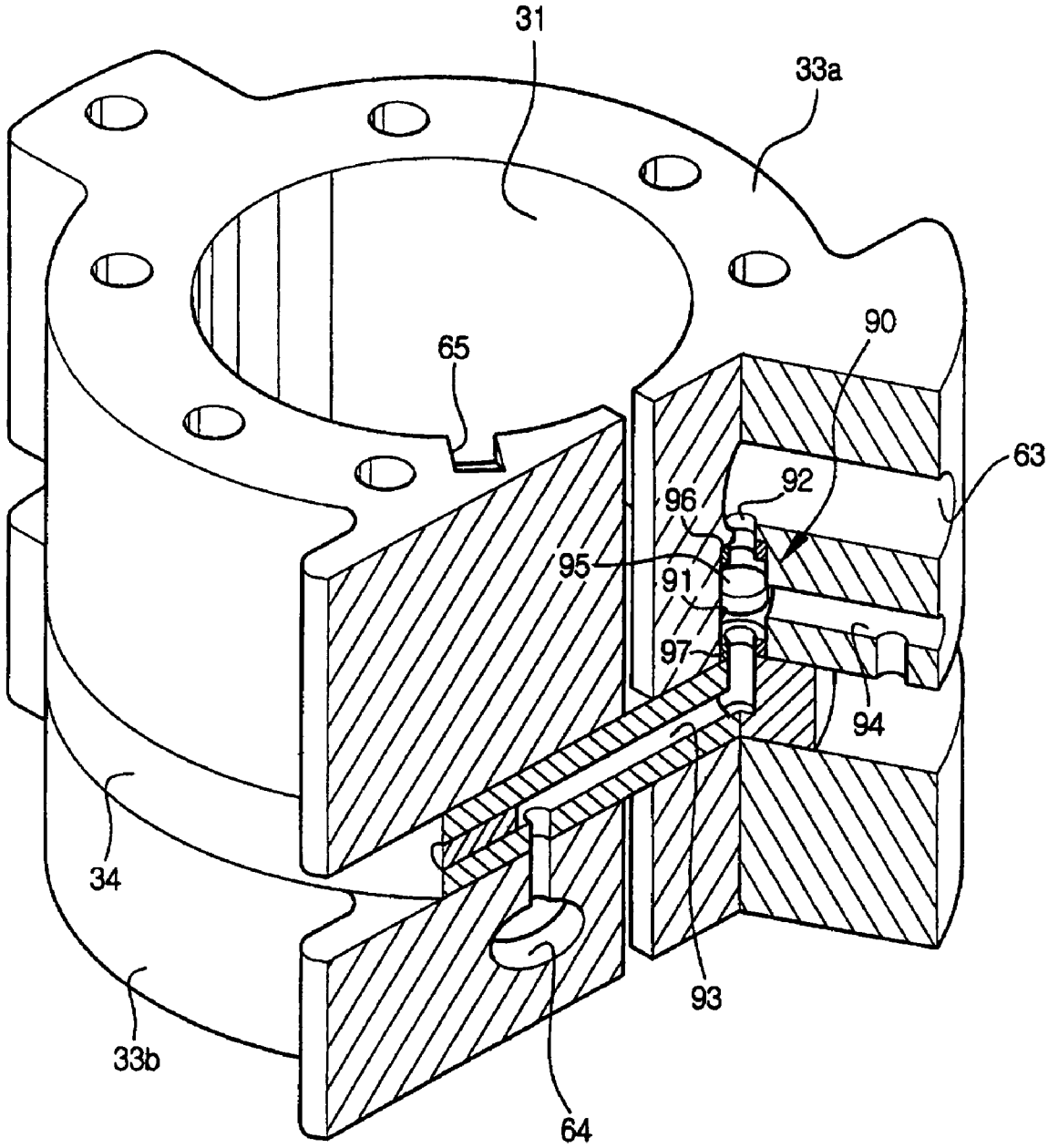
FIG. 7 is a partial sectioned perspective view of a pressure controller included in the variable capacity rotary compressor of FIG. 1.
Figure 8:
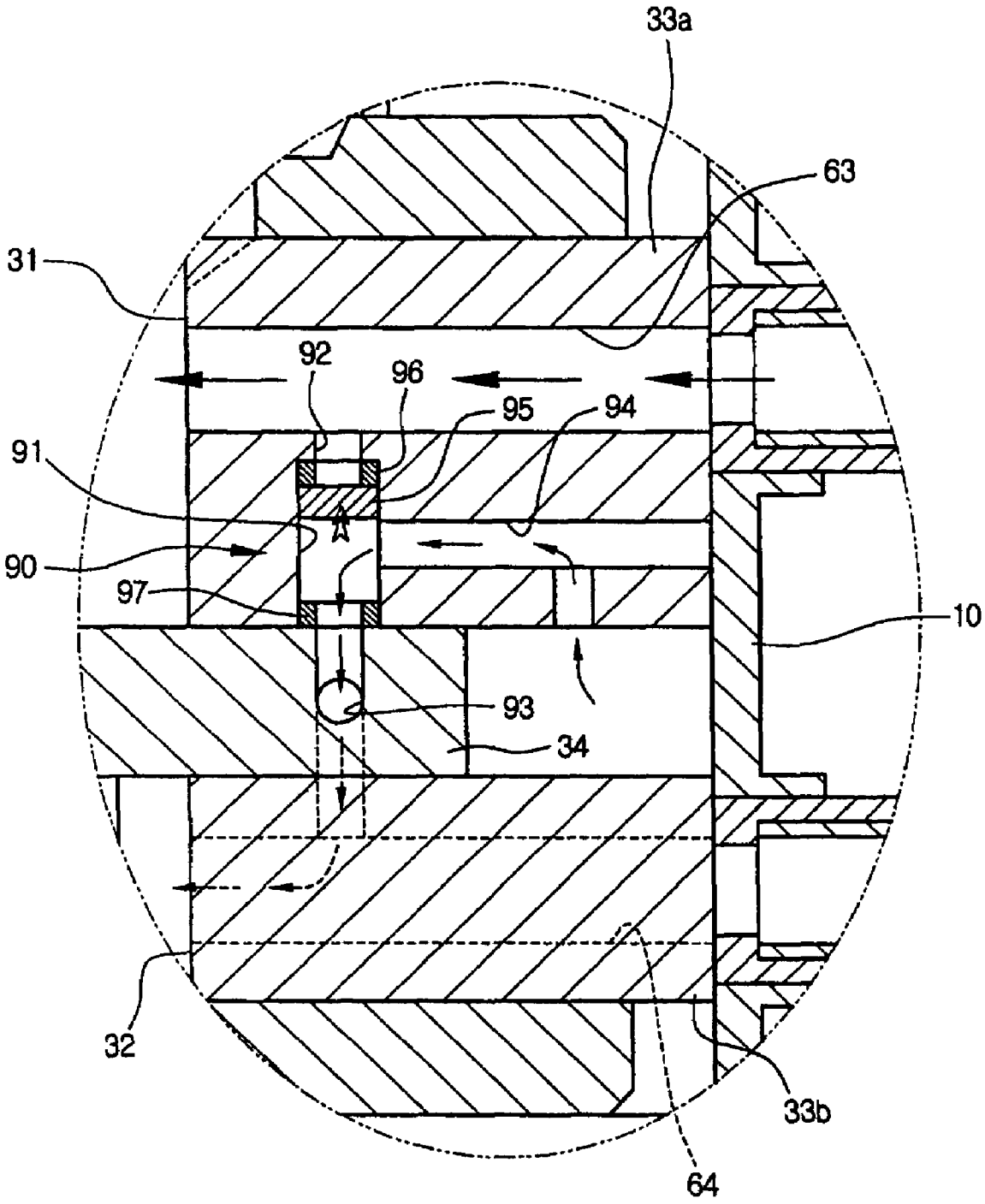
FIG. 8 is a sectional view of the pressure controller included in the variable capacity rotary compressor of FIG. 1, when the idle operation is executed in the second compression chamber.

As shown in FIGS. 7 and 8, the pressure controller 90 includes a path control chamber 91, first and second inlet channels 92 and 93, a communicating channel 94, and a valve unit. The path control chamber 91 is provided at a predetermined portion of the first housing 33*a* which has a larger capacity than the second housing 33*b*. The first and second inlet channels 92 and 93 are formed to connect both ends of the path control chamber 91 to the first and second inlets 63 and 64 of the first and second compression chambers 31 and 32, respectively. The communicating channel 94 connects the interior of the hermetic casing 10 to a middle portion of the path control chamber 91. The valve unit is provided in the path control chamber 91 to control an internal path of the path control chamber 91.

The path control chamber 91 is provided at the predetermined portion of the first housing 33*a* to be positioned under the first inlet 63 of the first compression chamber 31. An upper portion of the path control chamber 91 communicates with the first inlet 63 of the first compression chamber 31, through the first inlet channel 92. Further, a lower portion of the path control chamber 91 communicates with the second inlet 64 of the second compression chamber 32, through the second inlet channel 93 which is formed along a predetermined portion of the partition 34 to be connected to the second inlet 64. The communicating channel 94 is provided at a predetermined portion of the first housing 33*a* in a radial direction so that an inlet of the communicating channel 94 is open to communicate with the interior of the hermetic casing 10, and an outlet of the communicating channel 94 communicates with the middle portion of the path control chamber 91. Through such a construction, the outlet pressure of the hermetic casing 10 is applied to an interior of the path control chamber 91 through the communicating channel 94, and then applied to the first or second inlet 63 or 64. The path control chamber 91 may be provided at the second housing 33*b* or the partition 34. However, in an embodiment of the invention the path control chamber 91 is provided at the first housing 33*a* having a thicker thickness than the second housing 33*b*, to allow the pressure control chamber 91 to be easily manufactured during a process of manufacturing the compressor.

The valve unit, which is provided in the path control chamber 91, includes a disc-shaped valve member 95 and first and second valve seats 96 and 97. The valve member 95 is set in the path control chamber 91 to move up and down. The first and second valve seats 96 and 97 are provided at upper and lower ends of the path control chamber 91, respectively. Each of the first and second valve seats 96 and 97 has a hole at a center thereof. Thus, due to a pressure difference between the first and second inlets 63 and 64, the valve member 95 moves upward or downward in the path control chamber 91 to close one of the first and second inlet channels 92 and 93 while opening a remaining one of the first and second inlet channels 92 and 93, to allow a pressure of an outlet side of the compressor to be applied to the first or second compression chamber 31 or 32 where the idle operation is executed.

The operation of the variable capacity rotary compressor will be described in the following.

Figure 4:
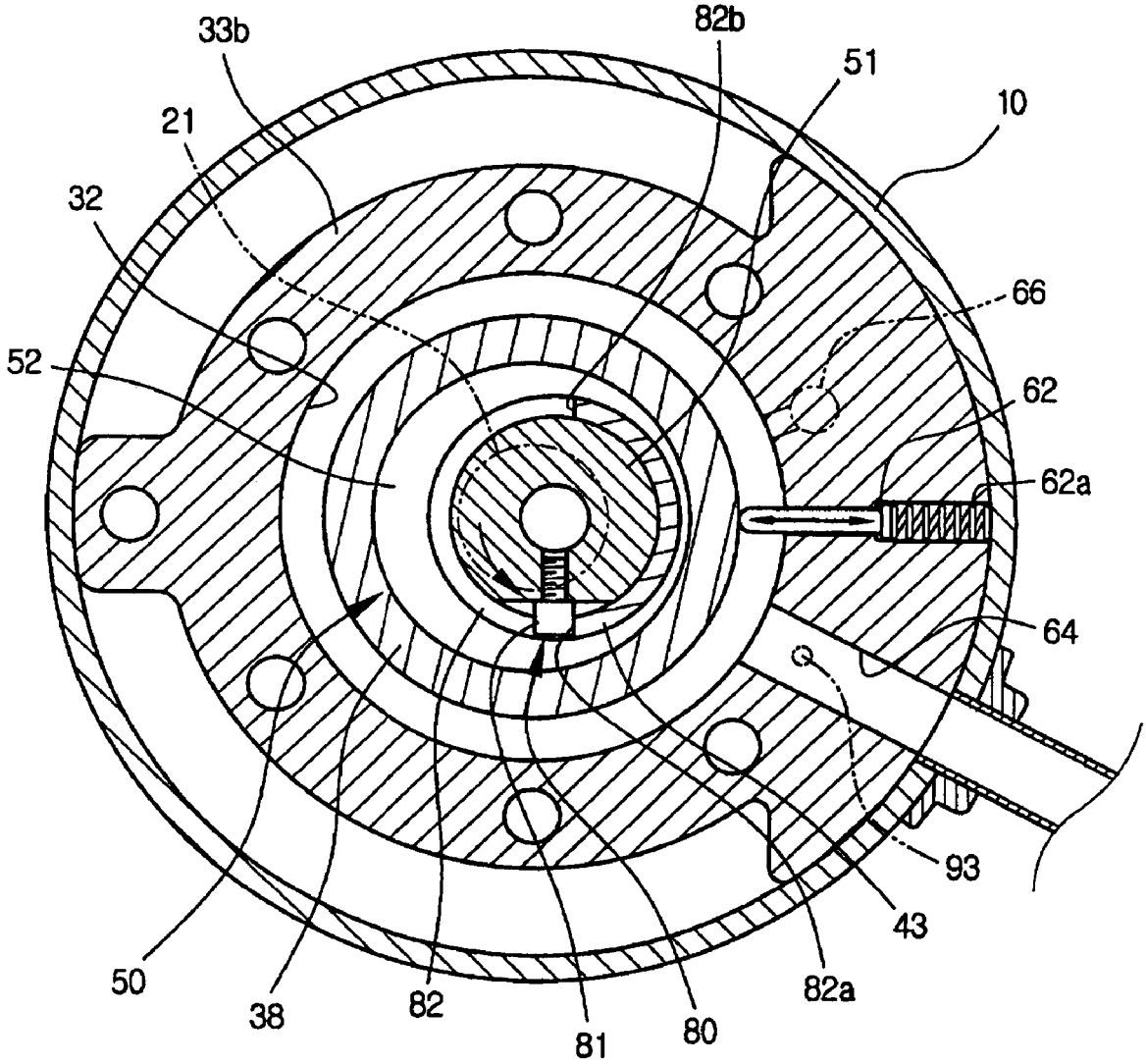
FIG. 4 is a sectional view to illustrate an idle operation of a second compression chamber, when the rotating shaft of the variable capacity rotary compressor of FIG. 1 is rotated in the first direction.

As shown in FIG. 3, when the rotating shaft 21 is rotated in a first direction, an outer surface of the first eccentric bush 42 in the first compression chamber 31 is eccentric from the rotating shaft 21 and the locking pin 81 is locked by the first locking part 82*a* of the locking slot 82. Thus, the first roller 37 is rotated while coming into contact with an inner surface of the first compression chamber 31, thus executing the compression operation in the first compression chamber 31. Meanwhile, in the second compression chamber 32 where the second eccentric bush 52 is placed, an outer surface of the second eccentric bush 52, which is eccentric in a direction opposite to the first eccentric bush 42, is concentric with the rotating shaft 21, and the second roller 38 is spaced apart from an inner surface of the second compression chamber 32, as shown in FIG. 4, thus the idle operation is executed in the second compression chamber 32. When the compression operation is executed in the first compression chamber 31, the refrigerant is delivered into the inlet port 63 of the first compression chamber 31. Thus, the path controller 70 controls the refrigerant path so that the refrigerant is delivered into only the first compression chamber 31.

When the compression operation is executed in the first compression chamber 31 and the idle operation is executed in the second compression chamber 32, as shown in FIG. 8, the valve member 95 moves upward in the path control chamber 91, due to the pressure difference between the first and second inlets 63 and 64, thus closing the hole of the valve seat 96 which is adjacent to the first inlet 63. In a detailed description, when the compression operation is executed in the first compression chamber 31, a suction force acts on the first inlet 63. Thus, the valve member 95 moves upward to close the hole of the valve seat 96 which is connected to the first inlet channel 92. At this time, the hole of the valve seat 97 which is connected to the second inlet channel 93 is open, thus allowing the second inlet 64 of the second compression chamber 32 to communicate with the interior of the hermetic casing 10 through the communicating path 94. Thus, the outlet pressure of the hermetic casing 10 is transmitted to the second compression chamber 32 through the communicating path 94, the path control chamber 91, the second inlet channel 93, and the second inlet 64. Such an operation allows an internal pressure of the second compression chamber 32 where the idle operation is executed, to be equal to the internal pressure of the hermetic casing 10, which is the pressure of the outlet side of the compressor, thus preventing the second vane 62 from pressing the second roller 38 which executes the idle rotation and preventing oil from flowing into the second compression chamber 32, therefore minimizing a rotating resistance of the rotating shaft 21.

Figure 5:
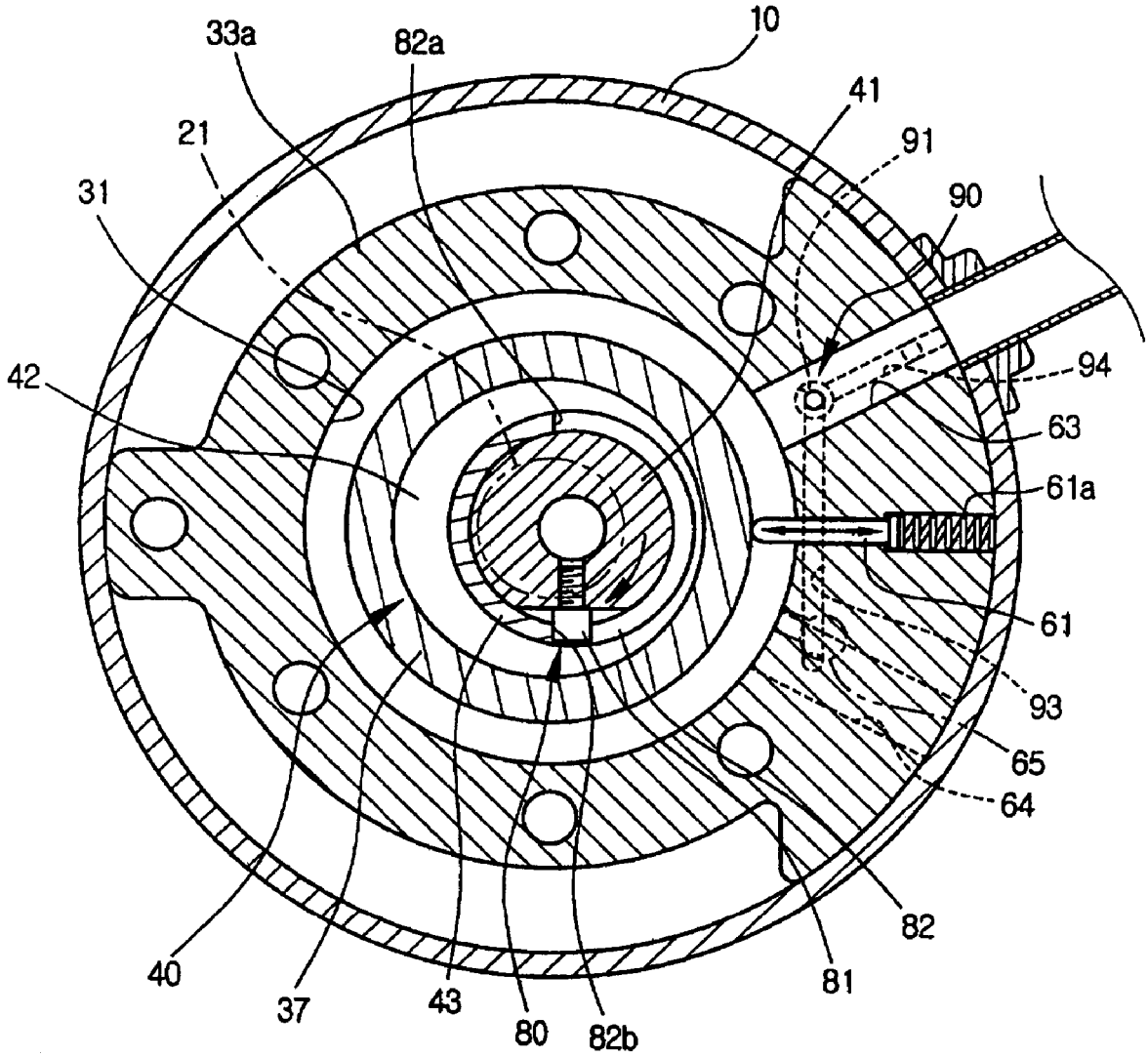
FIG. 5 is a sectional view to illustrate an idle operation of the first compression chamber, when the rotating shaft of the variable capacity rotary compressor of FIG. 1 is rotated in a second direction.
Figure 6:
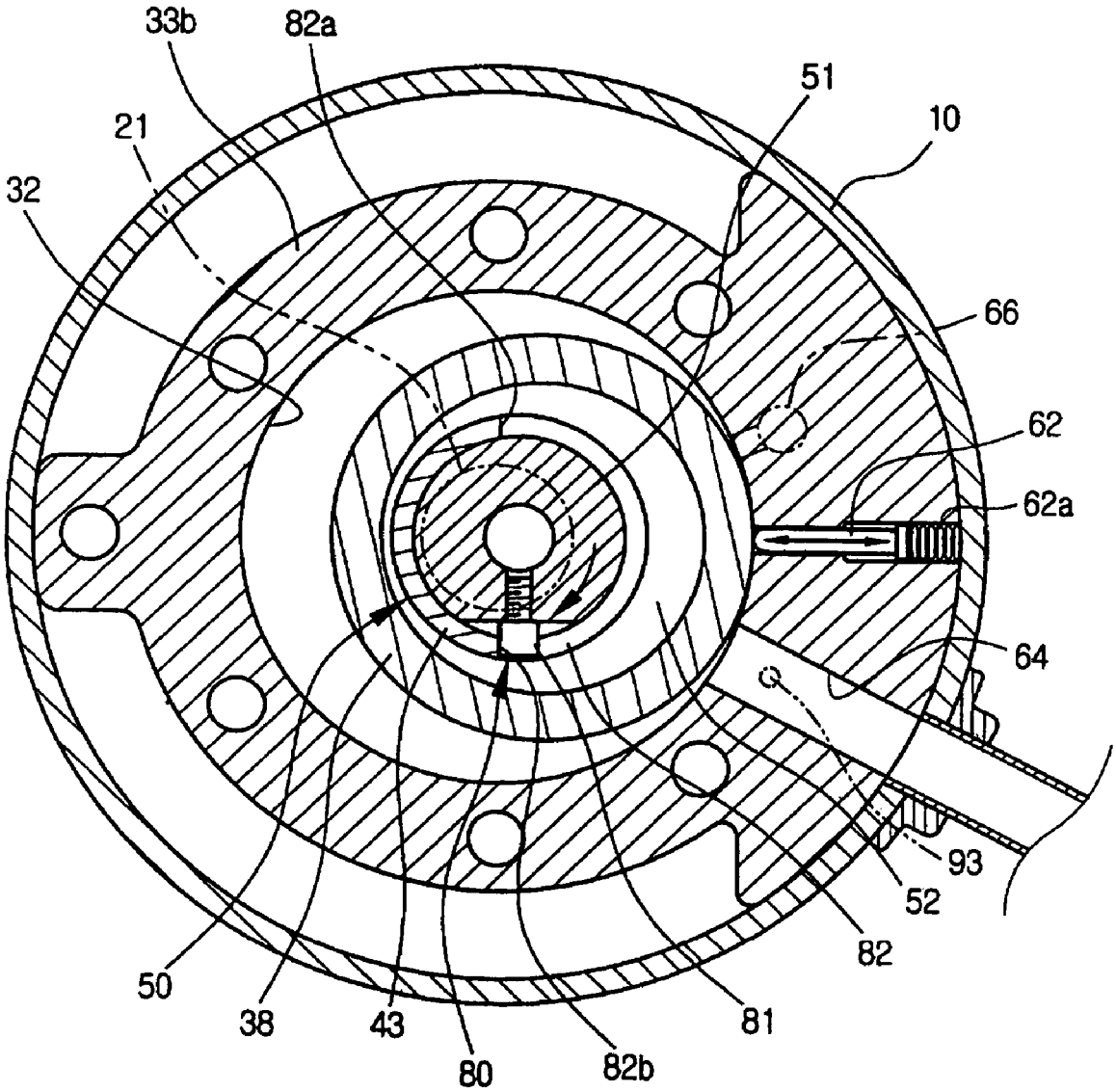
FIG. 6 is a sectional view to show a compression operation of the second compression chamber, when the rotating shaft of the variable capacity rotary compressor of FIG. 1 is rotated in the second direction.

Meanwhile, as shown in FIG. 5, when the rotating shaft 21 is rotated in a second direction, the outer surface of the first eccentric bush 42 in the first compression chamber 31 is released from the eccentricity from the rotating shaft 21 and the locking pin 81 is locked by the second locking part 82*b* of the locking slot 82. Thus, the first roller 37 is rotated while being spaced apart from the inner surface of the first compression chamber 31, so that the idle operation is executed in the first compression chamber 31. Meanwhile, in the second compression chamber 32 where the second eccentric bush 52 is placed, the outer surface of the second eccentric bush 52 is eccentric from the rotating shaft 21, and the second roller 38 is rotated while being in contact with the inner surface of the second compression chamber 32, as shown in FIG. 6, thus the compression operation is executed in the second compression chamber 32. When the compression operation is executed in the second compression chamber 32, the refrigerant is delivered into the inlet port 64 of the second compression chamber 32. Thus, the path controller 70 controls the refrigerant path so that the refrigerant is delivered into only the second compression chamber 32.

Figure 9:
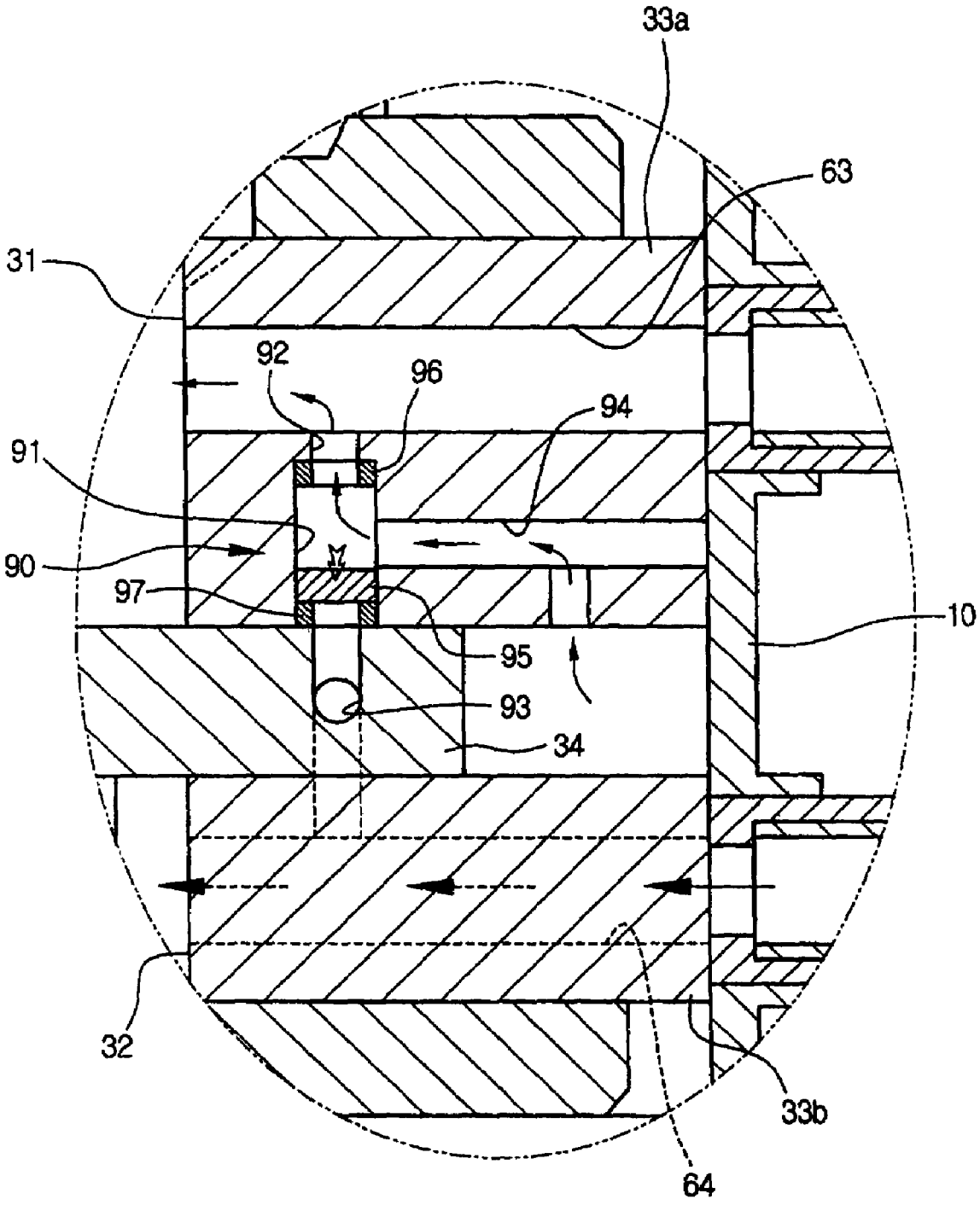
FIG. 9 is a sectional view of the pressure controller included in the variable capacity rotary compressor of FIG. 1, when the idle operation is executed in the first compression chamber.

When the compression operation is executed in the second compression chamber 32 and the idle operation is executed in the first compression chamber 31, as shown in FIG. 9, the valve member 95 moves toward the second inlet channel 93 in the path control chamber 91, by the suction force of the second inlet 64, thus closing the hole of the valve seat 97 which is adjacent to the second inlet channel 93. At this time, the hole of the valve seat 96 adjacent to the first inlet channel 92 which communicates with the first inlet 63, communicates with the communicating path 94. In this case, since the first compression chamber 31 has the same pressure as the interior of the hermetic casing 10, the first vane 62 does not press the first roller 37 which executes the idle rotation, and oil does not flow into the first compression chamber 31, thus allowing the rotating shaft 21 to be smoothly rotated.

As is apparent from the above description, the present invention provides a variable capacity rotary compressor, which is designed such that a compression operation is selectively performed in one of two compression chambers having different capacities, according to a rotating direction of a rotating shaft, thus precisely varying a compression capacity to obtain a desired exhaust pressure, and easily controlling the compression capacity of the rotary compressor.

Further, the present invention provides a variable capacity rotary compressor having a pressure controller which is operated to apply a pressure of an outlet side of a hermetic casing to a compression chamber where an idle operation is executed, so that there is no pressure difference between the interior of the compression chamber where the idle operation is executed and the interior of the hermetic casing, thus preventing a vane installed in the compression chamber where the idle operation is executed from pressing a roller and preventing oil from flowing into the compression chamber where the idle operation is executed, and thereby minimizing a rotating resistance, therefore increasing operational efficiency of the compressor.

Further, the present invention provides a variable capacity rotary compressor, which is designed such that first and second inlet channels of a pressure controller communicate with first and second inlets of first and second compression chambers, respectively, and a valve member of the pressure controller is moved by a pressure difference between the first and second inlets, thus changing an internal path of the pressure control chamber, therefore allowing the pressure controller to be smoothly operated.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A variable capacity rotary compressor, including a hermetic casing, a housing installed in the hermetic casing to define therein first and second compression chambers having different capacities, and a compressing unit, placed in the first and second compression chambers, to execute a compression operation in either the first or second compression chamber according to a rotating direction of a rotating shaft which drives the compressing unit, the variable capacity rotary compressor comprising:

a pressure controller to apply an outlet pressure of the compressor to either the first or second compression chamber where an idle operation is executed, the pressure controller comprising:

a path control chamber provided at a portion of the housing outside the first and second compression chambers, first and second inlet channels to connect both ends of the path control chamber to inlet ports of the first and second compression chambers, respectively, a communicating channel to connect an interior of the hermetic casing of the compressor to a middle portion of the path control chamber, and a valve unit provided in the path control chamber to control an internal path of the path control chamber so that the communicating channel communicates with either the first or second inlet channel.

2. The variable capacity rotary compressor according to claim 1, wherein the valve unit comprises a valve member, which reciprocates in the path control chamber.

3. The variable capacity rotary compressor according to claim 2, wherein the valve unit further comprises first and second valve seats which are provided on the ends of the path control chamber, respectively, each of the first and second valve seats having a hole at a center thereof.

4. The variable capacity rotary compressor according to claim 1, wherein the housing comprises:

a first housing to define the first compression chamber therein;

a second housing to define the second compression chamber therein; and a partition interposed between the first and second housings so that the first and second compression chambers are partitioned from each other.

5. The variable capacity rotary compressor according to claim 4, wherein the first compression chamber has a higher capacity than the second compression chamber, and the path control chamber is provided at a portion of the first housing, and the second inlet channel is provided at a portion of the partition to allow the path control chamber to communicate with the inlet port of the second compression chamber.

6. The variable capacity rotary compressor according to claim 5, wherein the communicating channel is provided at a portion of the first housing, with an inlet of the communicating channel being open to communicate with an interior of the hermetic casing.

7. A pressure controller of a variable capacity rotary compressor, which includes a hermetic casing, encased first and second compression chambers, and a compressing unit in the first and second compression chambers, to execute a compression operation in either the first or second compression chamber according to a rotating direction of a rotating shaft, to apply an outlet pressure of the compressor to either the first or second compression chamber where an idle operation is executed, the pressure controller comprising:

a path control chamber outside the encased first and second compression chambers;

first and second inlet channels to connect both ends of the path control chamber to inlet ports of the first and second compression chambers, respectively;

a communicating channel to connect an interior of the hermetic casing of the compressor to a middle portion of the path control chamber; and a valve unit provided in the path control chamber to control an internal path of the path control chamber so that the communicating channel communicates with either the first or second inlet channel.

8. The pressure controller according to claim 7, wherein the valve unit comprises a valve member which reciprocates in the path control chamber.

9. The pressure controller according to claim 8, wherein the valve unit further comprises first and second valve seats provided on the ends of the path control chamber, respectively.

10. The pressure controller according to claim 9, wherein each of the first and second valve seats includes a hole at a center thereof.

11. The pressure controller according to claim 7, further comprising a housing which define the first and second compression chambers, wherein the housing comprises:

a first housing including the first compression chamber;

a second housing including the second compression chamber; and a partition interposed between the first and second housings to partition the first and second compression chambers.

12. The pressure controller according to claim 11, wherein the first compression chamber has a higher capacity than the second compression chamber.

13. The pressure controller according to claim 12, wherein the path control chamber is provided at a portion of the first housing.

14. The pressure controller according to claim 13, wherein the second inlet channel is provided at a portion of the partition to allow the path control chamber to communicate with the inlet port of the second compression chamber.

15. The pressure controller according to claim 14, wherein the communicating channel is provided at a predetermined portion of the first housing.

16. The pressure controller according to claim 15, further comprising an inlet of the communicating channel is open to communicate with the interior of the hermetic casing.

* * * * *